US006238252B1

(12) United States Patent
Flieger

(10) Patent No.: US 6,238,252 B1
(45) Date of Patent: May 29, 2001

(54) FLAT PLUG-IN CONTACT MEMBER FOR ELECTRICAL PLUG-IN CONNECTIONS

(75) Inventor: Richard Flieger, Stammham (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/472,222

(22) Filed: Dec. 27, 1999

Related U.S. Application Data

(63) Continuation of application No. PCT/DE98/01654, filed on Jun. 17, 1997.

(51) Int. Cl.[7] ..... H01R 13/432
(52) U.S. Cl. ..... 439/746; 439/884
(58) Field of Search ..... 439/746, 877, 439/878, 879, 880, 881, 882, 883, 884

(56) References Cited

U.S. PATENT DOCUMENTS

| | | | | |
|---|---|---|---|---|
| 4,046,450 | | 9/1977 | Yurtin | 439/746 |
| 5,083,944 | * | 1/1992 | Pitts | 439/595 |
| 5,545,055 | * | 8/1996 | Tanaka et al. | 439/507 |
| 5,591,054 | * | 1/1997 | Okada et al. | 439/884 |
| 5,795,197 | * | 8/1998 | Tsuji et al. | 439/884 |
| 5,989,079 | * | 11/1999 | Seko et al. | 439/884 |
| 5,989,080 | * | 11/1999 | Tsuji et al. | 439/884 |

FOREIGN PATENT DOCUMENTS

| | | |
|---|---|---|
| 0 572 874 A1 | 12/1993 | (EP) . |
| 0 821 435 A2 | 1/1998 | (EP) . |

* cited by examiner

*Primary Examiner*—Brian Sircus
*Assistant Examiner*—Michael C. Zarroli
(74) *Attorney, Agent, or Firm*—Herbert L. Lerner; Laurence A. Greenberg; Werner H. Stemer

(57) ABSTRACT

A contact member contains a stamped/bent part having a line terminal element, a box-shaped intermediate region and a contact blade formed of two blade halves protruding from the latter. The blade halves and a top wall of the intermediate region are disposed in a developed view of the stamped/bent part one behind the other in alignment in a longitudinal direction with respect to a bottom wall of the intermediate region. As a result, as small a pitch as possible of stamped/bent parts on a sheet-metal strip is achieved. The contact blade is formed by folding together the blade halves at a transverse bending line resulting in a blade having twice the material thickness. The top wall of the intermediate region which is connected to one of the blade halves comes to lie between the side walls of the intermediate region and forms a closed rectangular box of high stability.

11 Claims, 3 Drawing Sheets

FLAT PLUG-IN CONTACT MEMBER FOR ELECTRICAL PLUG-IN CONNECTIONS

CROSS-REFERENCE TO RELATED APPLICATION

This is a continuation of copending International Application PCT/DE98/01654, filed Jun. 17, 1997, which designated the United States.

BACKGROUND OF THE INVENTION

Field of the Invention

The invention concerns a flat plug-in contact member for electrical plug-in connections containing a stamped/bent part with a line terminal element at one end of the contact member. An intermediate region follows the line terminal element and is bent to form a cross-sectionally rectangular box with two side walls. A bottom wall connects the two side walls along with a top wall. A contact blade formed of two halves is provided at the other end of the contact member and the blade protrudes from the intermediate region and is thicker than the other regions.

Such flat plug-in contact members are often used as flat connectors in the case of motor-vehicle plug-in connectors, where they are exposed to aggressive operating conditions. Such contact members are Often configured with a contact blade of, for example, 2.8×0.63 mm or 5.2×0.63 mm and, owing to the required resistance to being stood on, for example, must have high mechanical stability. For this reason, the intermediate region of such a contact member, that is to say the region between the contact blade and the line terminal element, is often configured as a rectangular, closed box. The contact blade itself must also have a certain stability for mechanical and electrical reasons. It is therefore usually formed with twice the material thickness of the other regions of the contact member.

European Patent EP 0 572 874 B1 discloses a contact member of the type stated at the beginning which is produced from a stamped/bent part and has a cross-sectionally rectangular, box-shaped intermediate region, to which a contact blade of twice the material thickness is joined. The contact blade is in this case formed by two halves, which are attached as extensions to the side walls of the intermediate region and, by bending up the side walls and folding them laterally together, form a complete contact blade of twice the material thickness. In the case of such a contact member, a relatively great pitch of the stamped sheet-metal parts lying next to one another in a sheet-metal strip is obtained in the developed view of the intermediate region and the contact blade.

Furthermore, German Patent DE 195 39 714 C1 likewise discloses a flat plug-in contact member of the type stated at the beginning. In this contact member the original stamped/bent part is initially of a uniform thickness, which corresponds to the final thickness of the contact blade and is reduced, for example by a milling tool, in the terminal region and in the intermediate region to approximately half the material thickness of the original material. In the case of this contact member, an additional processing operation is therefore envisaged for producing the material thickness provided in the individual regions. Here, the contact blade is joined to the base wall of the intermediate region, which apart from the base wall has the two side walls and the top wall. Here too, a relatively great pitch of the stamped sheet-metal parts is obtained in the developed view of the contact member.

SUMMARY OF THE INVENTION

It is accordingly an object of the invention to provide a flat plug-in contact member for electrical plug-in connections that overcomes the above-mentioned disadvantages of the prior art devices of this general type.

With the foregoing and other objects in view, a flat plug-in contact member for electrical plug-in connections is provided in accordance with the invention. The flat plug-in contact member includes a stamped/bent part having a longitudinal direction and a material thickness. The stamped/bent part contains a line terminal element, a box-shaped intermediate region, and a contact blade. The line terminal element is defined at a first end of the stamped/bent part. The box-shaped intermediate region follows the line terminal element. The box-shaped intermediate region is bent to form a cross-sectionally rectangular box having two side walls, a bottom wall connecting the two side walls, a top wall, and a height. The contact blade is disposed at a second end of the stamped/bent part and is formed by a connecting location, a first blade half, and a second blade half. The contact blade protrudes from the intermediate region and is thicker than both of the line terminal element and the box-shaped intermediate region. The first blade half runs in alignment in the longitudinal direction and adjoins the bottom wall of the box-shaped intermediate region. The second blade half adjoins the first blade half. The top wall adjoins the second blade half. The second blade half is bent back through one-hundred-eighty degrees (180°) over the first blade half at the connecting location of the first and second blade halves by a folding transverse to the longitudinal direction of the first and second blade halves. The contact blade thereby is twice the material thickness, and the top wall thereby comes to lie between the two side walls for forming the box-shaped intermediate region.

The invention is based in particular on the object of making it possible in the case of a flat plug-in contact member of the type stated at the beginning, with a box-shaped intermediate region and a contact blade thicker than the other regions, not only to meet the customary requirements for such contact members, in particular with respect to mechanical stability, but also to produce the contact member more efficiently from a stamped/bent part.

This object is achieved according to the invention by providing that, in the developed view of the stamped/bent part, the first blade half running in alignment in the longitudinal direction is joined to the bottom wall of the intermediate region. The second blade half running in alignment in the longitudinal direction adjoins the first blade half. The top wall running in alignment in the longitudinal direction adjoins the second blade half. The second blade half is bent back through 180° over the first blade half at the connecting location of the two blade halves by a folding transverse to the longitudinal direction of the blade halves. In a folded state, a contact blade of twice the material thickness is formed, and that the top wall thereby comes to lie between the two side walls for forming the box-shaped intermediate region.

In the case of such a flat plug-in contact member, the contact blade halves run in alignment with one another in the longitudinal direction, the complete contact blade of twice the material thickness being formed by folding transversely to the longitudinal direction and bending back the second blade half through 180° over the first blade half. Furthermore, as a difference in comparison with the known flat plug-in contact members of the type stated at the beginning, the top wall of the intermediate region is provided in alignment in the longitudinal direction on the second blade half, so that there is obtained for the production of the contact member in a stamping/bending operation an original part which, although longer overall than known contact members, is distinctly narrower, and consequently, in spite of the configuration of the contact member in a box shape, smaller pitches are achieved on a sheet-metal strip. This allows better overall material utilization in spite of a wider sheet-metal strip. Since, together with the bending operation for the contact blade, the top wall also comes to lie between the two side walls of the intermediate region. The box shape of the intermediate region can be formed in a simple way, with the overall result that more efficient production of the contact member from a stamped/bent part is made possible. The shaping of the contact member according to the invention is also advantageous, including with regard to the achievable mechanical stability of the contact member, on account of the direct connection between the top wall of the intermediate region and the contact blade and the possibilities of a connection produced between the side walls of the intermediate region and the top wall. To be regarded as a further advantage of the contact member according to the invention is that the two blade halves are connected to one another by their configuration one behind the other in alignment in the longitudinal direction in such a way that, even after folding together, they remain connected at the tip of the contact blade, with the result that the latter cannot be opened up, for example during the plugging operation.

With regard to a construction of the contact member being as symmetrical as possible, it is advantageous if the first blade half is joined to the bottom wall and the top wall is joined to the second blade half in each case by the intermediate piece. The length of which is chosen in such a way that, after an offset of the first intermediate piece from the bottom wall and of the second intermediate piece from the second blade half, the fully folded contact blade is located centrally with respect to the height of the box-shaped intermediate region.

Simple mechanical connection possibilities between the top wall and the side walls of the intermediate region are obtained if the two side walls of the intermediate region are provided on the free longitudinal edges with tabs for bearing support and/or connection to the top wall. It is expedient in this case if the side walls of the intermediate region are in each case provided with three tabs, the two outer tabs being respectively provided for bearing support of the underside of the top wall, and the respectively middle tab being clamped on the outer upper side of the top wall with the latter.

Other features which are considered as characteristic for the invention are set forth in the appended claims.

Although the invention is illustrated and described herein as embodied in a flat plug-in contact member for electrical plug-in connections, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 5:
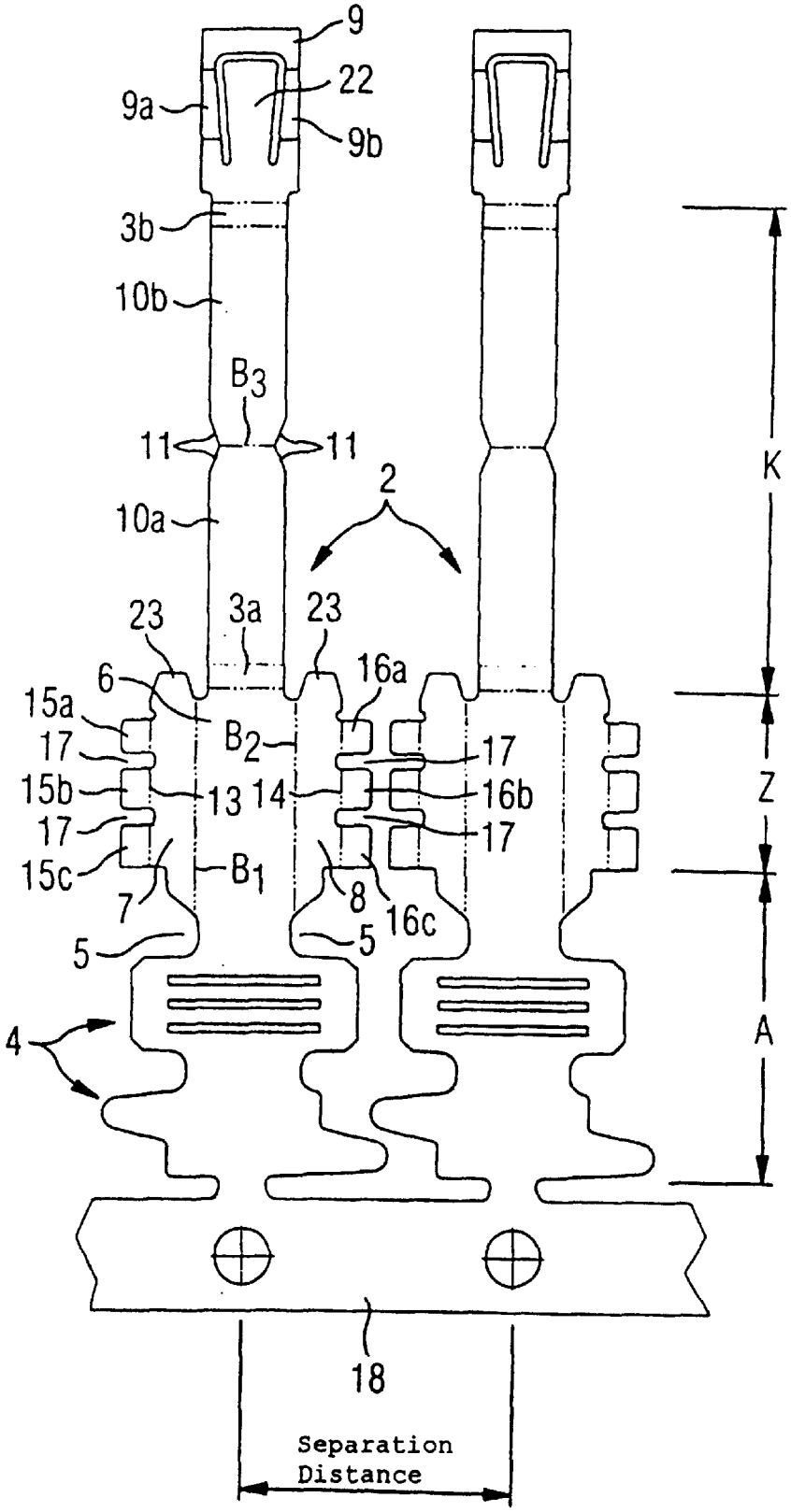
FIG. 5 is a top plan view of stamped/bent parts from which the contact members are produced.

In all the figures of the drawing, sub-features and integral parts that correspond to one another bear the same reference symbol in each case. Referring now to the figures of the drawing in detail and first, particularly, to FIGS. 1 and 5 thereof, there is shown a contact member 1 produced from a stamped/bent part 2, for example from a highly conductive Cu alloy. The stamped/bent part 2 has, as the developed (unfolded) view of two stamped/bent parts 2 hanging from a sheet-metal strip 18 in FIG. 5 shows best, a terminal region A at one end, an intermediate region Z following the terminal region A, and a contact region K at the other end protruding from the intermediate region Z. The stamped/bent part 2 has a uniform thickness of, for example, from approximately 0.3 mm to approximately 0.4 mm. In the terminal region A, a line terminal element, which is configured for example as a crimping element 4, but instead may also contain at least one insulation-piercing element, is formed by bending away. The intermediate region Z, following lateral incisions 5 of the terminal region A, has a bottom wall 6, two side walls 7 and 8, which are bent away at the bending lines B1 and B2 to form a cross-sectionally initially U-shaped channel, as well as a top wall 9, which will be discussed in more precise detail later. The top wall 9 is disposed in such a way that the intermediate region Z has a closed, cross-sectionally rectangular box shape.

A contact element, provided in the contact region K, of the flat plug-in contact member is formed by a contact blade 10, formed of two halves 10*a*, 10*b*, and has—as described below— in the final state twice the material thickness, that is to say a thickness of, for example, 0.63 mm or 0.8 mm. As the developed view of the contact member in FIG. 5 shows, the first half 10*a* of the contact blade 10 is joined by a short first intermediate piece 3*a* with a width of, for example, 2.8 or 5.2 mm to the bottom wall 6 of the intermediate region Z. The blade half 10*a* runs in the longitudinal direction up to a bending or folding line B3, before which the side edges of the blade half are formed with bevels 11. The first blade half 10*a* is adjoined in alignment in the longitudinal direction by the second blade half 10*b*, having in the region extending from the bending line B3 on the side edges, like the first blade half, that is to say mirror-invertedly with respect to the bending line B3, corresponding bevels 11. The second blade half 10*b* is of course of the same length as the first blade half 10*a*. At the end of the second blade half 10*b* there adjoins by a second intermediate piece 3*b*, corresponding in length to the first intermediate piece 3*a*, the previously mentioned top wall 9 of the intermediate region Z. The top wall 9 is somewhat wider than the blade halves 10*a* and 10*b* and is formed with a cut-free, resilient snap-in hook 22 for the snap-in engagement or primary securement when the contact member is disposed in a housing.

The production of the complete contact blade 10 as well as the final formation of the box-shaped intermediate region Z are now described below. First, the first blade half 10*a* is bent away from the bottom wall 6 by an offset 12 of the first intermediate piece 3*a*. The complete contact blade 10 is then formed at the connecting location of the two blade halves 10*a* and 10*b*, that is to say at the bending line B3, by a folding transverse to the longitudinal direction of the blade halves and by a bending back of the second blade half 10*b* through 180° over the first blade half 10*a*, i.e. the two blade halves 10*a* and 10*b* are now folded together in a congruent matter, the bevels 11 forming the tip of the blade. During the bending back of the second blade half 10*b*, the top wall 9 is also bent back in the direction of the intermediate region Z and is bent away from the second blade half 10*b* by use of a further offset 12' of the second intermediate piece 3*b*, with the result that the top wall 9 then comes to lie between the two side walls 7, 8 of the intermediate region Z and is thereby located in the region of upper free longitudinal edges 13, 14 of the side walls. In this state, the intermediate region Z then has the shape of a cross-sectionally rectangular box, on which the fully folded contact blade 10 protrudes, on account of a corresponding, i.e. respectively equal, length of the intermediate pieces 3*a* and 3*b*, centrally with respect to a height h of the intermediate region Z.

Figure 1:
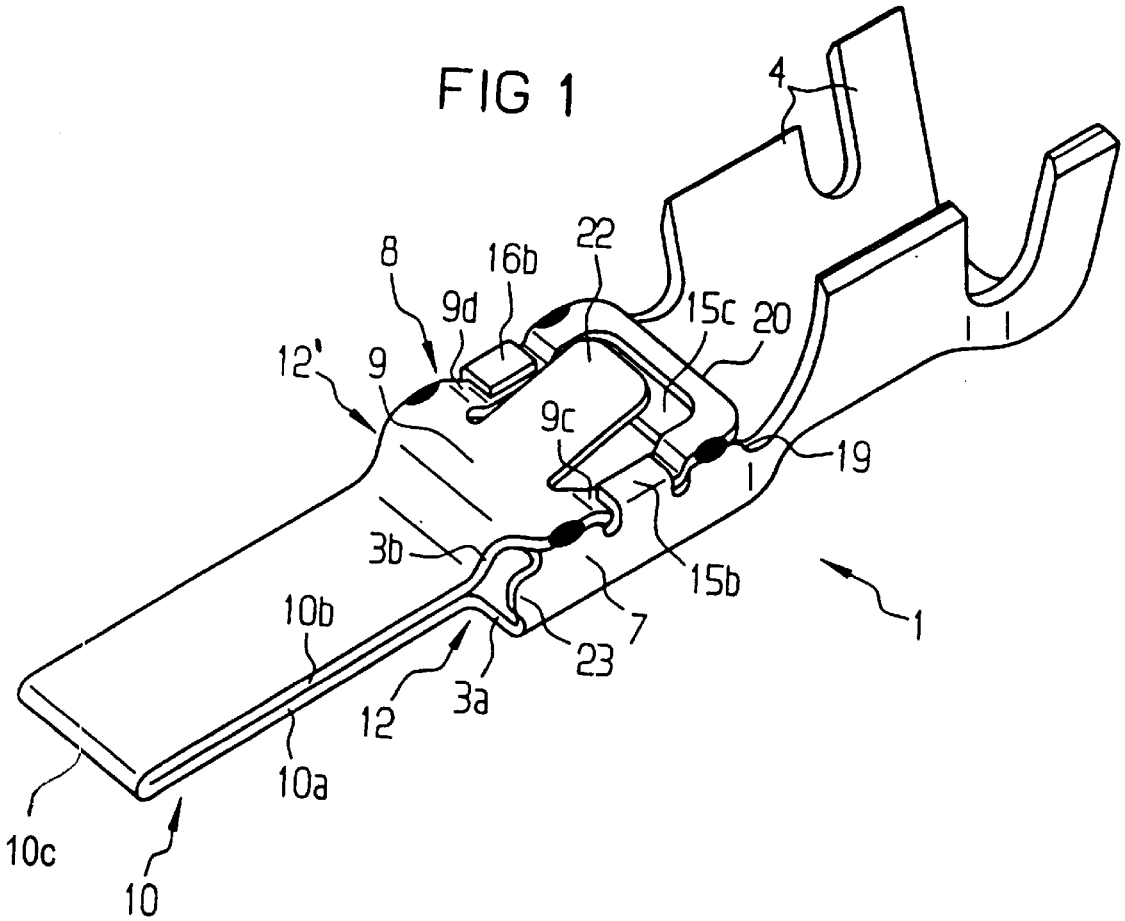
FIG. 1 is a diagrammatic, perspective view of a flat plug-in contract member according to the invention.
Figure 2:
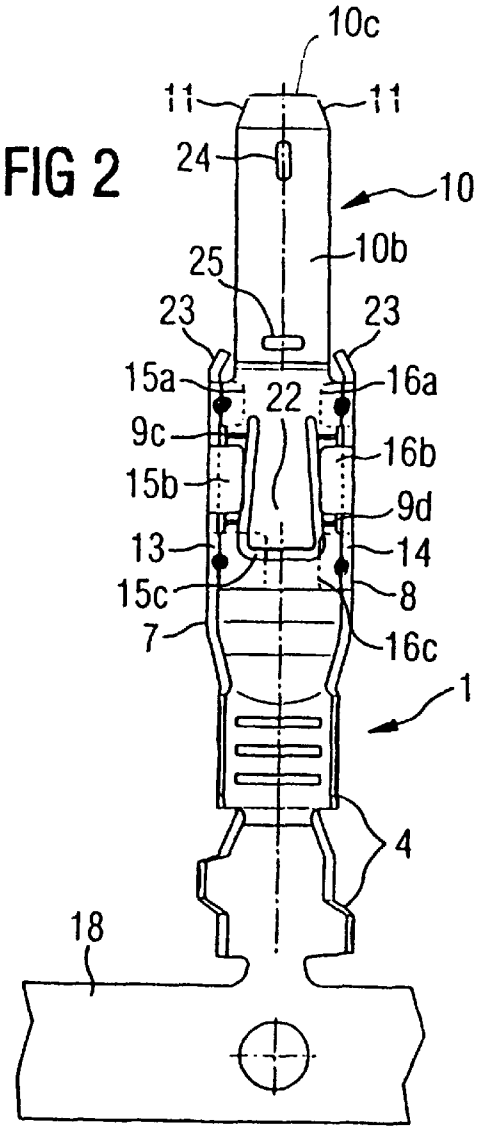
FIG. 2 is a top plan view of the contact member hanging from a sheet-metal strip.

To provide possibilities for an exact positioning of the top wall 9 between the side walls 7, 8 and for a mechanical connection with the side walls 7, 8, the two side walls 7, 8 are—as the developed view in FIG. 5 shows particularly clearly—formed at the free longitudinal edges 13, 14 with tabs 15 and 16, respectively, which are spaced laterally apart from one another by clearances 17. In the case of the exemplary embodiment represented, in each case three tabs 15*a*, 15*b*, 15*c* and 16*a*, 16*b*, 16*c* are provided, the two outer tabs 15*a*, 15*c* and 16*a*, 16*c* being respectively provided for bearing support of an underside of the top wall 9. While, the respectively middle tab 15*b* and 16*b* is clamped on an outer upper side of the top wall 9 with the latter (FIGS. 1 and 2). For this purpose, the top-wall parts 9*a* and 9*b*, located to the sides of the snap-in hook 22, are in each case formed in the region of the middle tabs 15*b* and 16*b* of the side walls 7, 8 with an indentation 9*c* and 9*d*, respectively. With a view to the required mechanical stability and strength of such contact members and with a view to better current-transfer properties, the top wall 9 is expediently connected undetachably, for example welded, in the region of the bearing-support tabs 15*a*, 15*c* and 16, 16*c* to the side walls 7, 8 of the intermediate region Z, in order to achieve as closed a box shape as possible, with high mechanical stability along with a high current-transfer capacity. Furthermore, it is advantageous if at least one of the bearing-support tabs, for example the tab 15*c* in FIG. 2, is constructed such that it reaches into a region of the snap-in hook 22. The bearing-support tab 15*c* consequently protects the snap-in hook 22 against overbending. For the sake of completeness, it should be mentioned that the intermediate region Z is formed also with a polarizing web 21 (see FIGS. 3 and 4), torn out of the bottom wall 6 at 90°. In addition, the side walls 7, 8 are provided at their front edge with inwardly inclined tabs 23, while rear edges 19 of the side walls 7, 8, together with a rear edge 20 of the top wall 9, form a bearing contact for a secondary securement when the contact member is disposed in a housing.

Figure 3:
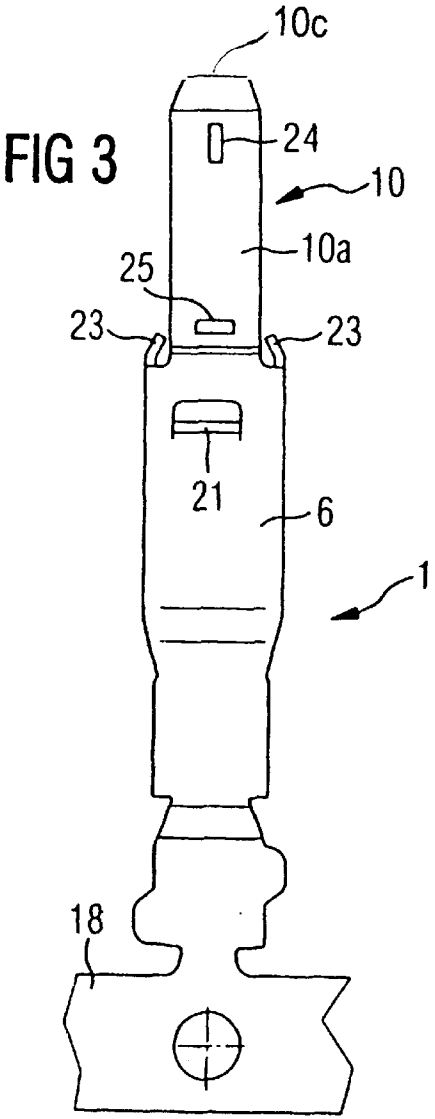
FIG. 3 is a bottom plan view of the contact member hanging from the sheet-metal strip.
Figure 4:
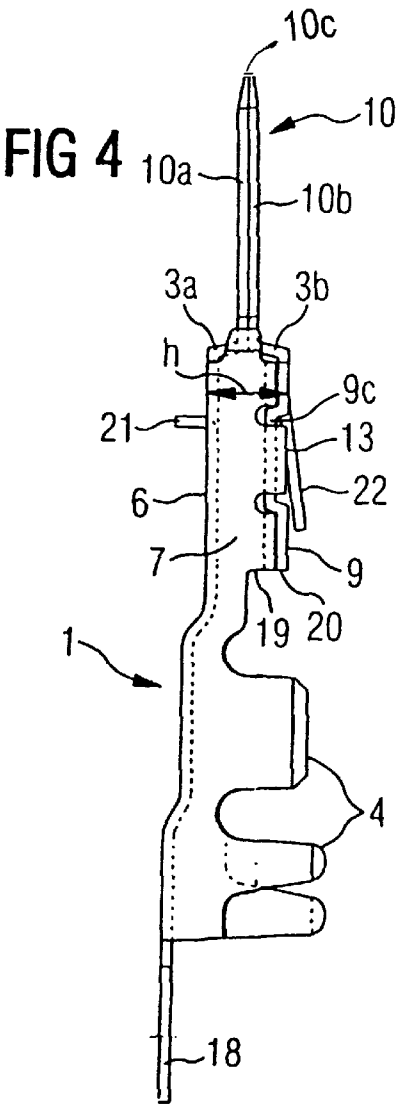
FIG. 4 is a side-elevational view of the contact member hanging from the sheet-metal strip.

As FIGS. 2 and 3 in particular further show, in the fully folded state, the two blade halves 10*a* and 10*b* may also additionally be mechanically connected to one another. This connection then expediently takes place at two locations 24, 25 in the region of the two ends of the contact blade 10, for example by two impressions or so-called clinch connections directed at 90° with respect to one another in the region of the center axis of the contact blade 10.

The preferred embodiment represented of a contact member according to the invention forms the flat connector with a stable box shape, virtually fully closed in the intermediate region Z with as small a pitch as possible, has a high current-transfer capacity, the snap-in hook 22 for primary securement and snap-in engagement in an insulating housing, bearing-contact surfaces for a secondary securement as well as the polarizing device 22 to prevent incorrect insertion and a device to protect the snap-in hook against overbending. This embodiment consequently satisfies in a particularly advantageous way all the requirements currently to be met by such contact members in aggressive operating conditions.

I claim:

1. A flat plug-in contact member for electrical plug-in connections, comprising:

a stamped/bent part having a longitudinal direction and a material thickness, said stamped/bent part including:

a line terminal element defined at a first end of said stamped/bent part;

a box-shaped intermediate region following said line terminal element bent to form a cross-sectionally rectangular box having two side walls, a bottom wall connecting said two side walls, a top wall, and a height; said two side walls of said box-shaped intermediate region having free longitudinal edges and tabs projecting from said free longitudinal edges for providing at least one of bearing support for and connection to said top wall; and a contact blade disposed at a second end of said stamped/bent part and formed of a connecting location, a first blade half, and a second blade half, said contact blade protruding from said intermediate region and being thicker than both of said line terminal element and said box-shaped intermediate region, said first blade half runs in alignment in said longitudinal direction and adjoins said bottom wall of said box-shaped intermediate region, said second blade half adjoins said first blade half, said top wall adjoins said second blade half, said second blade half being bent back through 180° over said first blade half at said connecting location of said first and second blade halves by a folding transverse to said longitudinal direction of said first and second blade halves, said contact blade thereby being twice said material thickness, and said top wall thereby comes to lie between said two side walls for forming said boxshaped intermediate region.

2. The flat plug-in contact member according to claim 1, wherein said stamped/bent part has a first intermediate piece joining said first blade half to said bottom wall and a second intermediate piece joining said top wall to said second blade half, said first and second intermediate pieces each having a given length such that after an offset of said first intermediate piece from said bottom wall and of said second intermediate piece from said second blade half, said contact blade is located centrally with respect to said height of said box-shaped intermediate region.

3. The flat plug-in contact member according to claim 1, wherein said first and second blade halves are mechanically connected to one another.

4. The flat plug-in contact member according to claim 3, wherein said contact blade has two ends and connections are disposed in a region of said two ends of said contact blade for connecting said first and second blade halves to each other.

5. The flat plug-in contact member according to claim 1, wherein said top wall has an underside and a topside, said two side walls are in each case provided with three of said tabs including two outer tabs and a middle tab, said two outer tabs provide bearing support of said underside of said top wall, and said middle tab is clamped on said topside of said top wall.

6. The flat plug-in contact member according to claim 5, wherein said top wall is connected undetachably in a region of said two outer tabs to said two side walls of said box-shaped intermediate region.

7. The flat plug-in contact member according to claim 5, wherein said top wall is formed of top-wall parts, said top-wall parts each have in a region of said middle tab an indentation formed therein for clamping engagement with said middle tab.

8. The flat plug-in contact member according to claim 5, wherein said top wall in a region of said box-shaped intermediate region is formed with a cut-free, resilient snap-in hook.

9. The flat plug-in contact member according to claim 8, wherein at least one of said two outer tabs is configured to reach into a region of said resilient snap-in hook and serves to protect said resilient snap-in hook against overbending.

10. A flat plug-in contact member for electrical plug-in connections, comprising:

a stamped/bent part having a longitudinal direction and a material thickness, said stamped/bent part including:

a line terminal element defined at a first end of said stamped/bent part;

a box-shaped intermediate region following said line terminal element bent to form a cross-sectionally rectangular box having two side walls, a bottom wall connecting said two side walls, a top wall, and a height; said bottom wall having a polarizing web formed from and extending out from said bottom wall bent at approximately 90° with regard to said bottom wall; and a contact blade disposed at a second end of said stamped/bent part and formed of a connecting location, a first blade half, and a second blade half, said contact blade protruding from said intermediate region and being thicker than both of said line terminal element and said box-shaped intermediate region, said first blade half runs in alignment in said longitudinal direction and adjoins said bottom wall of said box-shaped intermediate region, said second blade half adjoins said first blade half, said top wall adjoins said second blade half, said second blade half being bent back through 180° over said first blade half at said connecting location of said first and second blade halves by a folding transverse to said longitudinal direction of said first and second blade halves, said contact blade thereby being twice said material thickness, and said top wall thereby comes to lie between said two side walls for forming said box-shaped intermediate region.

11. The flat plug-in contact member according to claim 5, wherein said top wall is welded in a region of said two outer tabs to said two side walls of said box-shaped intermediate region.

* * * * *